United States Patent [19]

Musschoot

[11] Patent Number: 4,620,586

[45] Date of Patent: Nov. 4, 1986

[54] METHOD AND APPARATUS FOR RECLAIMING FOUNDRY SAND

[75] Inventor: Albert Musschoot, Barrington, Ill.

[73] Assignee: General Kinematics, Barrington, Ill.

[21] Appl. No.: 738,884

[22] Filed: May 28, 1985

Related U.S. Application Data

[63] Continuation of Ser. No. 918,515, Jun. 23, 1978, abandoned, which is a continuation-in-part of Ser. No. 780,670, Mar. 23, 1977, abandoned, which is a continuation-in-part of Ser. No. 761,414, Jan. 21, 1977, abandoned.

[51] Int. Cl.[4] ..... B22C 5/08

[52] U.S. Cl. ..... 164/253; 164/5; 164/412

[58] Field of Search ..... 164/5, 6, 48, 61, 76, 164/131, 253, 270, 344, 412, 132, 345, 160, 250; 241/DIG. 9, DIG. 10, 1; 264/37; 159/DIG. 16; 34/92, 242; 432/203; 202/205; 203/12, 91; 134/17

[56] References Cited

U.S. PATENT DOCUMENTS

| | | | |
|---|---|---|---|
| 987,837 | 3/1911 | Staunton | 34/167 X |
| 1,482,812 | 2/1924 | Roberts | 34/167 X |
| 2,098,024 | 11/1937 | Bailey | 34/92 |
| 2,597,896 | 5/1952 | Oster | 164/132 X |
| 2,766,496 | 10/1956 | Ward | 164/5 X |
| 3,027,651 | 4/1962 | Nerge | 34/92 X |

FOREIGN PATENT DOCUMENTS

| | | | |
|---|---|---|---|
| 257703 | 11/1970 | U.S.S.R. | 164/5 |

*Primary Examiner*—Kuang Y. Lin

*Attorney, Agent, or Firm*—Wood, Dalton, Phillips, Mason & Rowe

[57] ABSTRACT

The present invention relates to a method and apparatus to be used in the reclamation of foundry sand. Mold flasks containing foundry sand shaped by a pattern to form a cavity into which molten metal has been poured are, after the metal has set, subjected to greatly reduced atmospheric pressure whereby to cause the moisture in the foundry sand to evaporate into water vapor, thereby removing moisture and heat from the sand so that the particles can be reused free of lumps or clumping of sand.

6 Claims, 6 Drawing Figures

FURNACE
80

SHAKE-OUT
81
CASTING
SAND
2-WAY GATE
82
87
88
98
99
100
96
86
86
94
93
92
83
85
91
85
84
95
97
89
89
90

METHOD AND APPARATUS FOR RECLAIMING FOUNDRY SAND

CROSS-REFERENCE

This application is a continuation of application Ser. No. 918,515, filed June 23, 1978, now abandoned, which is a continuation-in-part of Ser. No. 780,670, filed Mar. 23, 1977, now abandoned, which is a continuation-in-part of Ser. No. 761,414, filed Jan. 21, 1977, now abandoned.

BACKGROUND OF THE INVENTION

In most foundry casting operations, a pattern is introduced into a box-like structure called a mold flask and moist sand is formed under pressure around the pattern. The pattern is then removed from the sand and hot metal is poured into the cavity where it sets or solidifies. The sand used consists basically of fine sand with a number of additives such as clay, binders, and Sea-Coal, which are mixed with water to produce a mechanical mixture which can be formed under pressure and retain its shape. In most foundry operations, the amount of moisture in the sand prior to the pouring of the hot metal will vary from 3% to 7 or 8%, depending upon the type of metal being poured.

In the usual foundry operation, after the metal solidifies in the cavity in the sand mold, the castings are generally passed over a machine called a shakeout, usually of vibratory nature, where the sand is shaken loose from the casting. During the metal pouring operation, of course, heat is transferred from the metal to the sand. Some of this heat is dissipated by evaporation of some of the moisture in the sand, but a good deal of the heat is retained by the sand. In modern foundries, the sand is reused, mold after mold, and the total sand used would continue to increase in temperature to an unusable point. Therefore, it has been the practice to provide a method of cooling the sand before it is reused in subsequent molds. To form a good mold, the temperature of the sand ideally should be under 125° F. The average temperature of the sand when the casting is removed from the mold can range from 200° F. to 600° F., or more, depending upon the cooling time and the sand-to-metal ratio in the mold.

There are several methods used for cooling sand such as, for example, leaving it in a pile overnight or for some period of time, and allowing the heat to be lost naturally. This method requires a great deal of space, a great deal of sand, together with rather heavy material handling apparatus. In other cases, the sand is passed through a fluid bed cooler in which ambient air is passed through the bed while it is being conveyed to cause evaporation of the moisture and cooling of the sand. Fluid bed coolers are expensive, and variations in the ambient temperature and humidity drastically affect the cooling rate. Furthermore, fluid bed coolers require the use of large dust collectors in order to prevent air pollution, etc.

Additionally, means must be provided, either as part of the shakeout or fluid bed cooler, for breaking up any clumps or lumps of sand which adhere together by reason of the entrained binders. This further complicates the system.

SUMMARY OF THE INVENTION

According to the present invention, the need for the usual shakeout is present only in one form of the invention and may be eliminated in another and the fluid bed cooler may be eliminated entirely. Furthermore, the necessity of a bag room (dust collector) used in conjunction with the fluid bed cooler is eliminated, and most if not all of the expensive binders and other additives to the sand are reclaimed for future use by recycling, and there is a further saving in energy because some of the heat of the sand and castings is preserved for utilization.

Previously, it had been thought necessary to subject the wet sand to a vacuum sufficient to cause the moisture to flash almost explosively into vapor. Reliance was had on this explosive action to break up the lumps of sand. As an example of the previous method, the Russian Pat. No. 257,703 subjects wet foundry sand to a pressure at least as low as 100 mm Hg. At this pressure, the boiling point of the water is around 0° C. and the Russian patentee points out that the explosive reaction of his process results in the destruction of the lumps in the sand. A similar approach is to be found in U.S. Pat. No. 2,597,896 to Oster, wherein moisture in the form of steam is actually added to a cold core. Steam under high pressure is added to the core in a chamber, and then the pressure is suddendly released. The result, according to the Oster patent, is a "sharp explosion."

It has been found that a process which produces an explosive reaction of water into water vapor by a sudden very large reduction in pressure, is undesirable. The explosive nature of such former processes not only requires the use of expensive equipment, but in some cases actually requires the addition of water. Eventually, such added water must be removed which adds to the expense of the process. Furthermore, the explosive nature of such former processes may produce dust which itself must be dealt with.

I have found that by exposing hot wet foundry sand, either while the casting is still within the mold cavity in the sand or even after the casting has been removed, to a reduced pressure below 3 psi absolute, and preferably around 1 psi absolute, moisture is quickly and effectively removed from the sand without explosive characteristics, and the sand is cooled to a reusable temperature.

In one form of the method and apparatus disclosed herein, the mold flask containing the sand and hot metal is introduced into a vacuum chamber where the pressure is then reduced to below 3 psi absolute and preferably down to about 1 psi absolute. The reduction in pressure causes the moisture in the sand to flash into vapor. A substantial loss of heat occurs because of the evaporation of the moisture. When subsequently removed from the mold flask, the sand falls away from the casting, and if there are depressions or cavities in the casting which might tend to hold sand, a simple form of shakeout screen may be used to remove all of the sand from the casting. As the sand is cooled, it may be reused almost immediately, and because there is no strong current or flow of fluid generated when the pressure is of the order of 1 psi absolute, there is little dusting of the clays and binders incorporated in the sand. Thus, not only are dust collectors unnecessary, the expensive additives to foundry sand are not lost, but remain in the mixture. What little binder material may be entrained in the flow of vaporized moisture from the vacuum chamber is fed into a condensing chamber where the vapor is condensed, carrying with it the entrained binders, both of which are then removed for reuse.

According to another form of the invention, the casting and sand are passed over a shakeout screen which separates the sand from the castings and then the sand itself is treated by being introduced into a container and subjected to a vacuum of no more than 3 psi absolute and as low as 1 psi absolute. The effect is to cool and dry the sand, similar to the cooling and drying in the first embodiment.

DESCRIPTION OF THE PREFERRED EMBODIMENT

Figure 1:
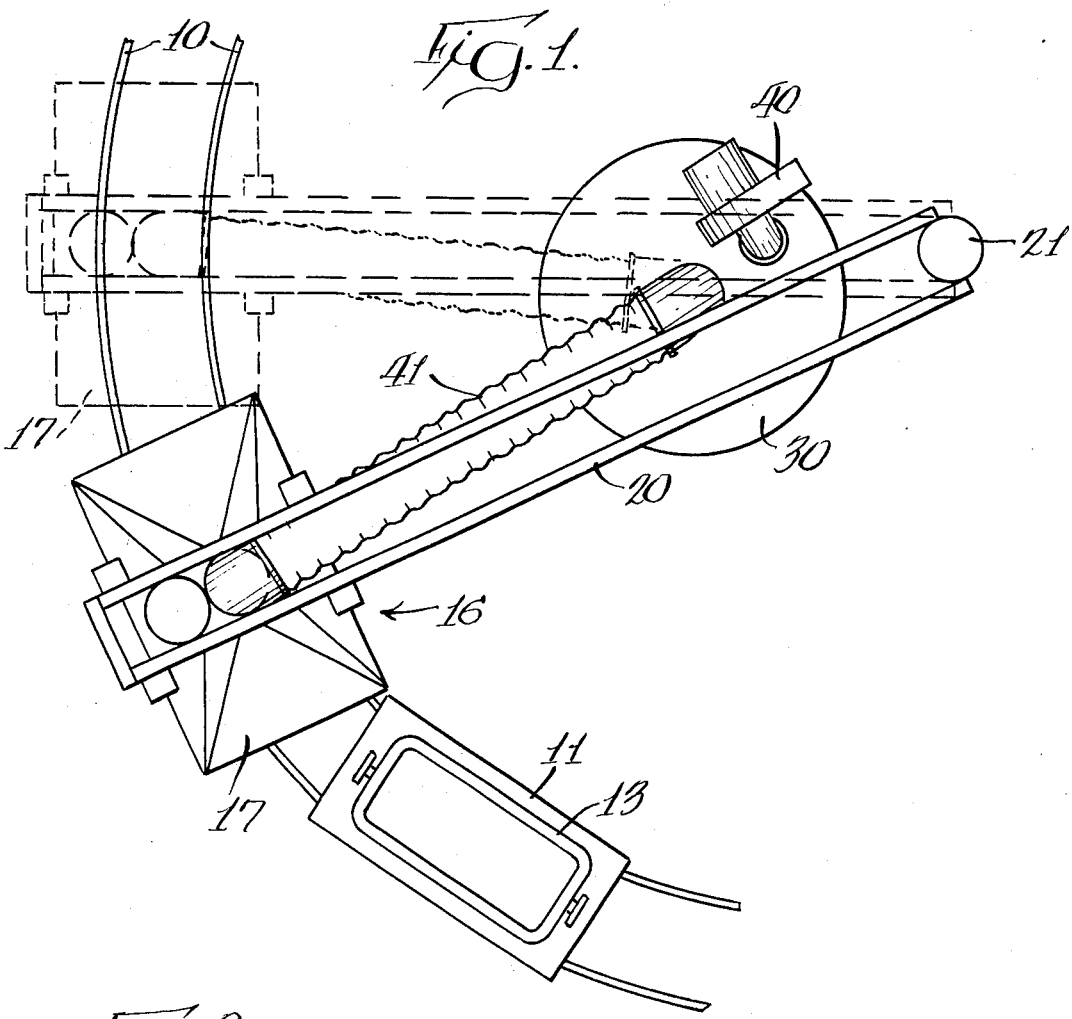
FIG. 1 is a top plan view showing one form of apparatus of the invention.
Figure 3:
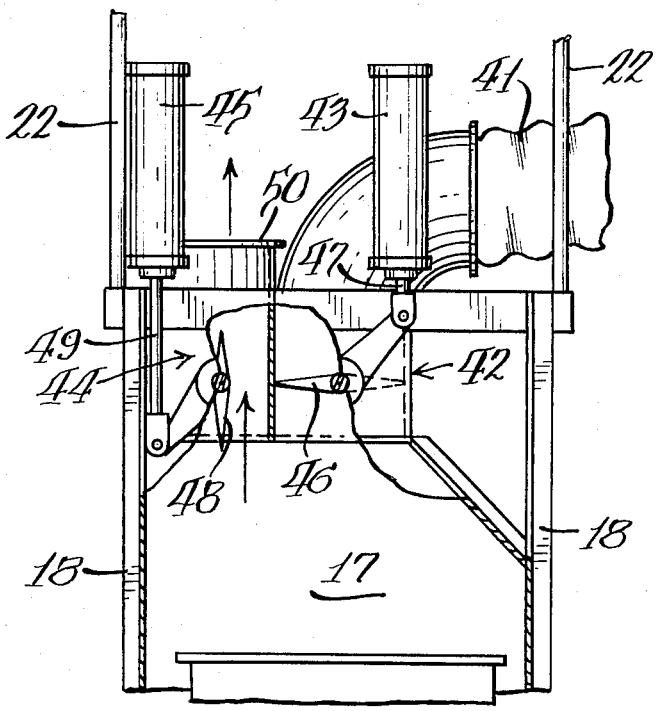
FIG. 3 is an enlarged detailed view of a portion of the apparatus shown in FIG. 2.

Referring now to the drawings, there is shown a curved track 10 along which wheeled carriers 11 may be moved. Each carrier is provided with a support floor 12 carrying a mold flask 13. The mold flask consists of the usual drag 14 and cope 15.

It will be assumed that hot metal has been poured into the cavity in each mold flask and has set firmly by the time the carriers have reached the position of FIG. 1. The sand temperature will be between 200° F. and 600° F. at this point in the process. It will be understood that the carriers 11 are moved slowly along the track 10 during the operation to be described, and the curved portion has been designated a vacuum station indicated generally at 16. At the vacuum station there is provided a vacuum chamber 17, being a 5-sided vessel having side walls 18, end walls, and a top wall, but with an open bottom as shown. The vacuum chamber is carried by a beam 20 secured to the upper portion of a gantry pivot crane 21. The vacuum chamber is connected to the beam 20 by piston rods 22 reciprocal in cylinders 23, one such piston and cylinder device being provided at each corner of the rectangular vacuum chamber.

It is contemplated that by reason of the piston and cylinder devices 22, 23, the vacuum chamber 17 will be lowered over a carrier 11 when the carrier reaches the position shown in solid lines in FIG. 1. At this point, the edges 24 of the open bottom of the vacuum chamber sealingly engage a seal 25 extending upwardly around the periphery of the floor of the carrier, thereby effecting a seal between the interior of the vacuum chamber 17 and the exterior.

Positioned adjacent the crane 21 is a condensing chamber 30 supported above the floor on legs 31. Preferably, the condensing chamber has a volume greater than the volume of the vacuum chamber. The condensing chamber is sealed from outside air and contains therein a condensing means in the form of a plurality of vertically arranged condensing tubes 32 through which cooled water entering through the inlet 33 is passed, with the water warmed by the condensation exiting through the outlet 34. Under normal operation, the inlet temperature of the water should be of the order of 60° F. and the exiting water will be somewhere around 70° F.

The condensing chamber 30 has a tapered bottom 35 leading to an effluent outlet 36. A pump 37 is provided to pump effluent, i.e., condensed vapor, and also to maintain the hereinafter described vacuum within the condensing chamber.

To maintain the condensing chamber at a very low pressure, a vacuum pump 40 is provided. As previously stated, the pressure in the condensing chamber should be less than 3 psi absolute, and preferably of the order of 1 psi absolute. Also, it is preferable that the volume of the condensing chamber be larger than the volume of the vacuum chamber 17.

A conduit 41 interconnects the vacuum chamber and condensing chamber. At the top of the vacuum chamber there is provided a vacuum valve 42 operated by a piston and cylinder device 43. Adjacent the vacuum valve is an air valve 44 operated by another piston and cylinder device 45. The vacuum valve 42 is of the butterfly type having a flapper 46, as is the air valve which has a flapper 48. The flapper of the valve 42 is operated by a rod 47 connected to a piston within the cylinder 43 while the flapper 48 of the air valve is operated by a rod 49 connected to a piston in the cylinder 45. An air exit is indicated at 50.

Figure 2:
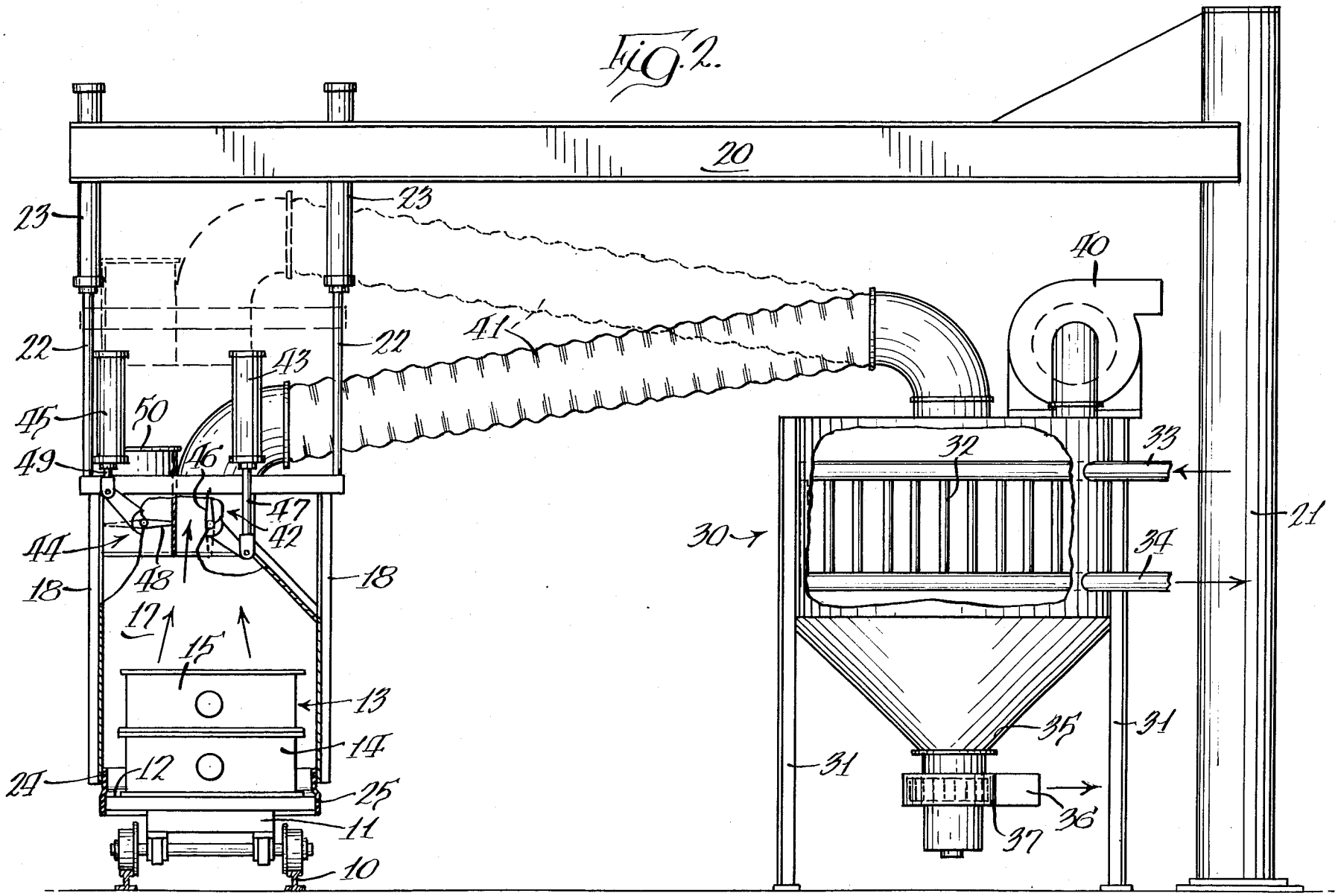
FIG. 2 is a side elevational view partially broken away of the apparatus shown in FIG. 1.

In operation, the vacuum pump 40 maintains the pressure within the condensing chamber 30 around 1 psi absolute. As a carrier 11 approaches the position shown in FIG. 1, the crane 21 is pivoted to bring the vacuum chamber over the carrier, whereupon the piston and cylinder devices 23 are operated to lower the vacuum chamber over the carrier to the position shown in FIG. 2. At this point, the piston and cylinder device 45 is operated to close the air valve 44, thus isolating the interior of the vacuum chamber from ambient conditions. Thereupon the vacuum valve 42 is operated by the piston and cylinder device to expose the interior of the vacuum chamber to the greatly reduced pressure existing in the condensing chamber and conduit 41. This reduction in pressure causes the moisture in the sand to evaporate into vapor. The evaporation of the moisture produces a substantial cooling of the sand, rendering it fit for immediate reuse. Vapor passing through the conduit 41 into the condensing chamber is condensed on the tubes 32 and is removed by the pump 37. Any binders or dust material which may be entrained in the vapors passes out of the condensing chamber with the condensed vapor exiting through the outlet 36. As the water exiting from the outlet may be reused to moisten sand for a subsequent molding operation, any binders or other fines carried by the vapor into the condensing chamber are, in effect, recycled along with the water. Very little fines will be carried into the condensing chamber because the actual volume of fluid (vapor and air) which passes through the conduit 41 and into the chamber 30 is relatively low and thus has very little power to carry entrained particles. and the removal of moisture from the sand being nonexplosive in nature, produces only an inconsequential amount of dusting.

After approximately 10 seconds, the vacuum valve 42 is closed and the air valve 44 is opened, thus admitting air into the vacuum chamber 17 so that the piston and cylinder devices 23 can lift it off the carrier. This will occur when the position shown in the dotted lines of FIG. 1 has been reached. The gantry crane is then rotated to return the vacuum chamber to its initial position, ready to be lowered over the next succeeding carrier.

Figure 4:
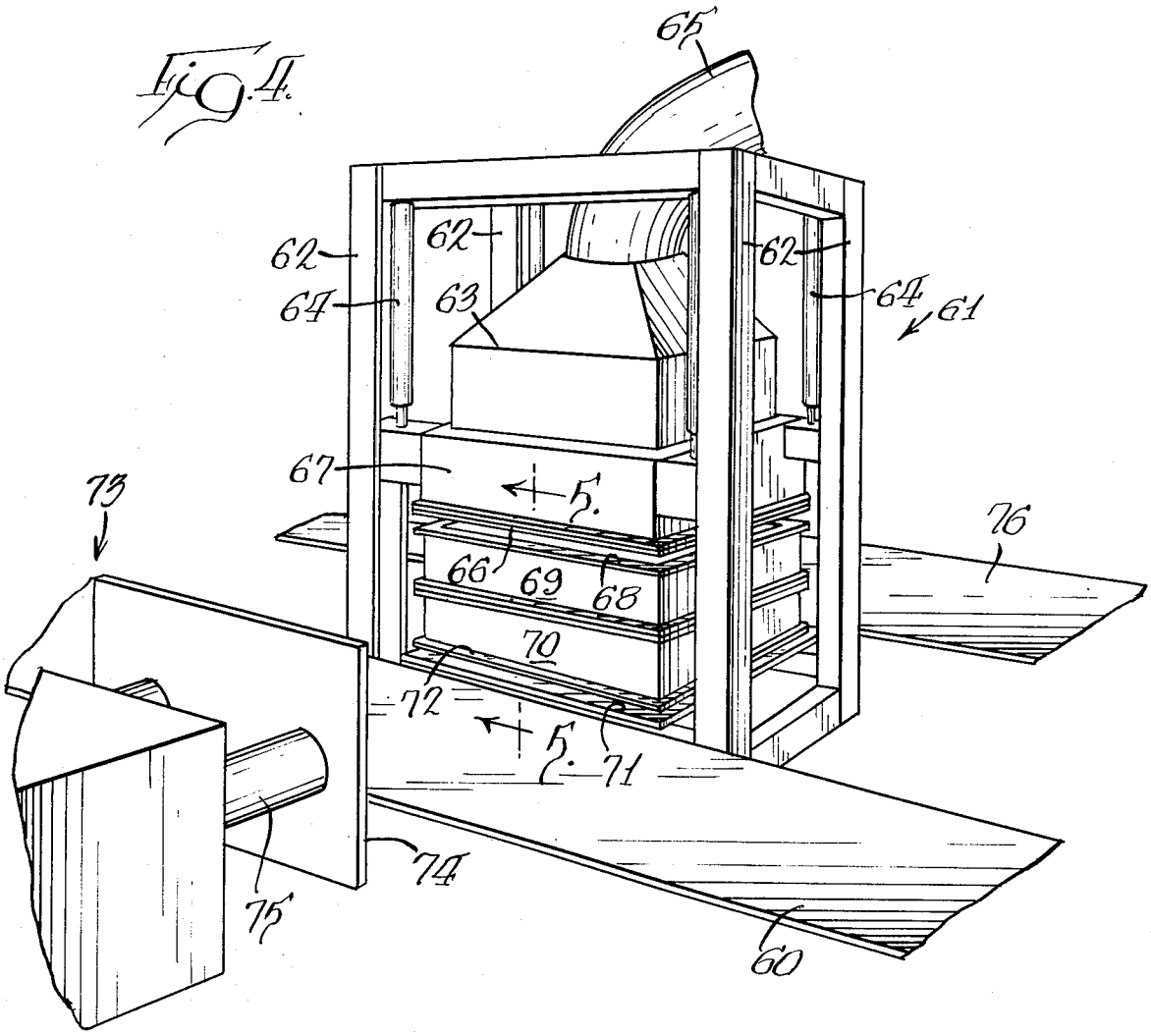
FIG. 4 is a side elevational view of a modified form of the invention.
Figure 5:
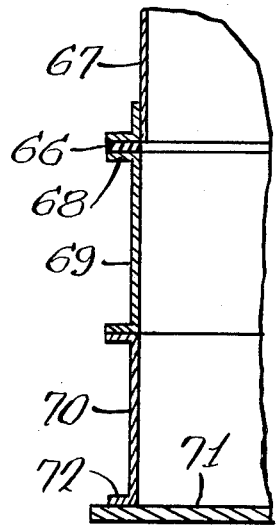
FIG. 5 is a vertical section taken along line 5—5 of FIG. 4.

A somewhat modified form of the invention is shown in FIGS. 4 and 5. In this embodiment, mold flasks are moved along a conveyor 60 to a vacuum station 61. The vacuum chamber includes four pillars 62 in which a vacuum hood 63 is vertically slidable by means of piston and cylinder devices 64 at each corner thereof. The bottom of the hood is rectangular in horizontal section. At the top of the hood there is provided a conduit 65 which is identical in operation with the conduit 41, i.e., interconnects the vacuum chamber with the condensing chamber and valves like the valves 42 and 44 are provided, although not shown.

A flexible seal 66 is provided all along the edges of the bottom 67 of the hood 63, and when the hood is lowered toward the top edge 68 of a cope 69, an effective seal is provided. The cope 69, of course, rests upon a drag 70 which in turn is supported by a floor 71 in the vacuum chamber. The bottom edge 72 of the drag, being flat and level, effects an efficient seal with the floor 71.

On the opposite side of the conveyor 60 from the vacuum station 61 is a pusher 73 which has a plate 74 carried by rods 75 actuated by suitable piston and cylinder devices, and operable to push a mold flask consisting of cope and drag off the conveyor and onto the floor 71 in the vacuum chamber. With the mold flask in the vacuum chamber, the piston and cylinder devices 64 lower the hood until the seal 66 makes full contact with the top edge 68 of the cope 69. At that time, the air valve (not shown) is closed and the vacuum valve (not shown) is opened, thereby to connect the interior of the hood which constitutes the vacuum chamber with the reduced pressure existing in the conduit 65 and the condensing chamber with which it communicates. Again, the sand will have cooled from the pouring process to a temperature of between 200° F. and 600° F., the pressure will be of the order of 1 psi absolute, and the resulting evaporation of water into vapor will occur just as in the embodiment previously described. After about 10 seconds duration, the vacuum valve is closed and the air valve is opened and the hood is raised above the mold flask. At this point, another mold flask passing along the conveyor will be opposite the pusher plate 74 and the actuation of the latter will push the just arrived mold flask onto the floor 71, thereby pushing the flask already therein onto the exit conveyor 76 for removal to an area where the casting is removed from the mold and the sand removed from the casting.

As previously pointed out, very little of the additives, clays, binders, etc., mixed with the sand are lost, and those that are entrained in the moving vapors are reclaimed in the condensing chamber for reuse. Additionally, the heat obtained from the condensation of vapors in the condensing chamber and exiting through the exit 34 may be used for other purposes, such as heating and the like. Thus, the heated water exiting from the outlet 34 may be fed to radiators or other heat exchangers thereby conserving energy which otherwise would be lost.

Figure 6:
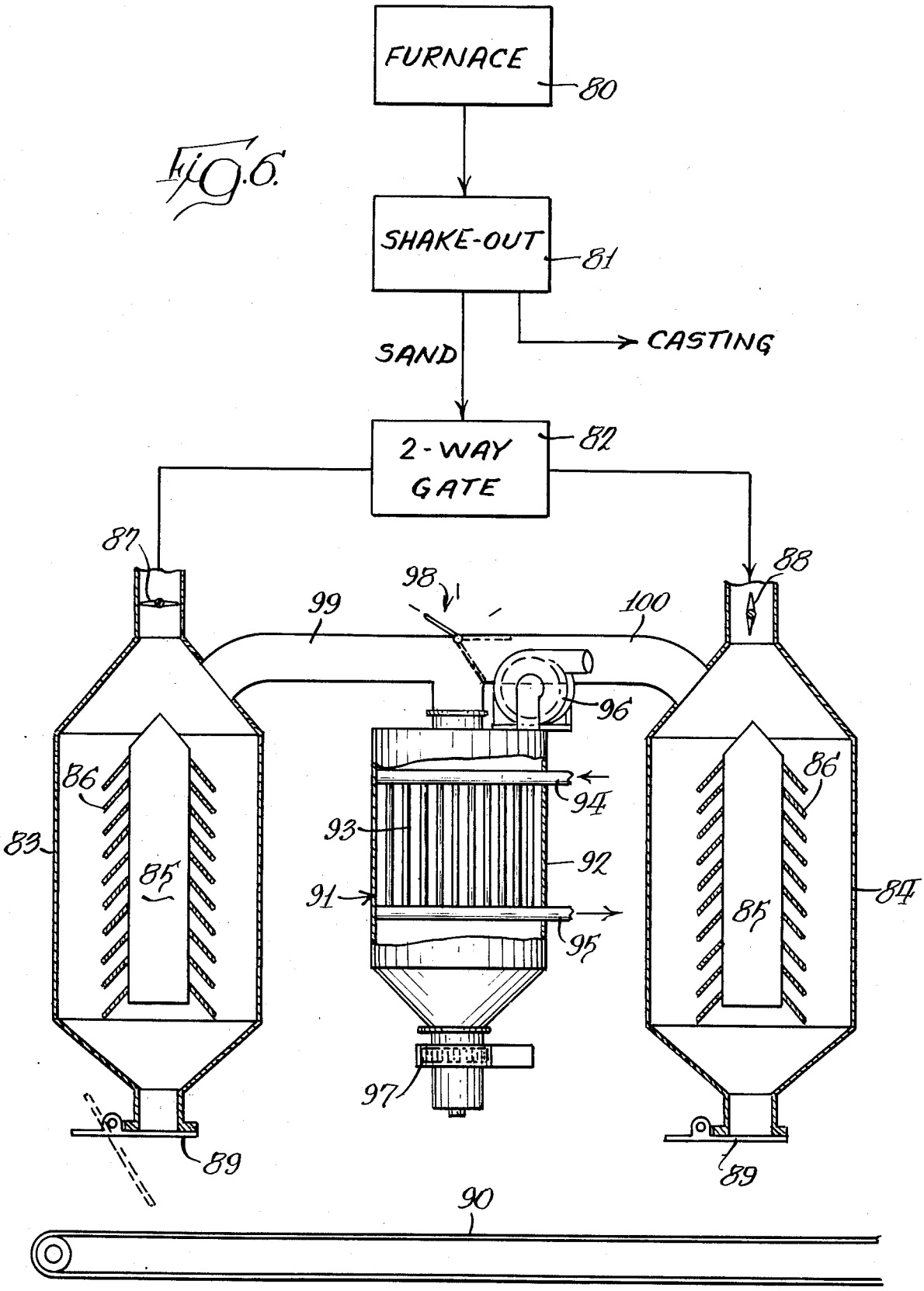
FIG. 6 is a generally schematic view partially in section of another form of the invention.

Referring to the second form of the invention illustrated in FIG. 6, there is shown schematically a pouring station 80 in which the molten metal is poured into the cavity formed in molding sand to form the casting. After the casting has cooled sufficiently so as to be self-supporting, the sand (which will be at a temperature of between 200° F. and 600° F.) and casting are passed onto a shakeout screen 81 which, through vibrations, etc., shakes the sand off the casting. The casting, substantially free of sand, is moved in one direction while the sand itself is moved onto a two-way gate 82. The two-way gate 82 is operable to direct sand from the shakeout into either of a pair of containers 83 and 84. Within each container is a deflector 85 provided with vanes 86 so as to assist in evening the distribution of sand therein. At the entrance end of each container is a valve, such as the valves 87 and 88, with the former being shown in a closed position whereby the container 83 is cut off from communication with the atmosphere, and with the latter valve 88 establishing communication between the interior of the container 84 and the atmosphere, and similarly permitting sand directed thereto by the two-way gate 82 to enter into the container. A pair of gate valves 89 are provided at the bottom of each container so that after the process is completed they may be opened, permitting the cooled and dried sand to pass from the container onto a suitable conveyor 90.

Associated with the two containers 83 and 84 is a condensing chamber 91 substantially similar to the condensing chamber 30 previously described. Thus, the condensing chamber is provided with a housing 92 having vertical cooling tubes 93 therein. An inlet 94 for coolant (usually cold water) communicates with the tubes 93, as does an outlet for heated coolant 95. A vacuum pump 96 is connected to the interior of the condensing chamber to maintain the pressure therein at less than 3 psi absolute and preferably about 1 psi absolute, as in the previously described embodiment. Similarly, a sump pump 97 is provided at the bottom of the condensing chamber to remove condensed water vapor and particulate matter entrained therein from the condensing chamber.

Located at the top of the chamber 91 is a three-way valve 98 operable when in a first position to connect the interior of the container 83 with the interior of the condensing chamber 91 by means of a conduit 99. The valve 98 in the second position connects the interior of the condensing chamber with the interior of the container 84 by means of the conduit 100. In its third position, the three-way valve blocks both conduits 99 and 100.

The operation of the apparatus just described and illustrated in FIG. 6 is substantially identical with the basic method described with reference to the previous form, with the exception that the hot sand is treated alone rather than while still in a flask or still associated with the casting. Thus, sand from the shakeout is directed by the two-way gate into the container 84 until the latter is full. Container 83 had previously been filled and upon completion of filling, the valve 87 was closed, cutting off communication between the interior of the container 83 and the atmosphere, and valve 98 is then moved to open conduit 99 exposing the interior of container 83 to the vacuum existing in the condensing chamber. The drop in pressure causes moisture in the sand to evaporate into water vapor and effect substantially instantaneous, or at least very rapid, cooling of the sand.

Water vapor so formed passes through the conduit 99 into the condensing chamber where it condenses on the tubes 93. In the meantime, container 84 is filling as it nears capacity, the three-way valve is moved to a position closing off both containers and the valve 89 on the container 83 is opened, as is valve 87, to expose the interior of the container 83 to atmospheric pressure and simultaneously to permit the sand to fall therefrom. At this point, valve 88 may be closed and valve 98 operated to expose the interior of the container 84 to the low pressure existing in the condensing chamber, and the two-way gate is operated to direct further sand into the container 83. Thus, one container is being filled while the sand in another is being treated so that a continuous operation may result.

I claim:

1. Apparatus for reclaiming moist foundry sand in a mold flask after molten metal has been poured at a pouring station into a cavity in the sand comprising means forming a condensing chamber, vacuum generating means operatively associated with said chamber for maintaining the condensing chamber at a pressure of about 1 psi absolute, a wheeled carrier having a support floor for supporting the mold flask, an open bottom vacuum chamber, means adjacent said carrier and connected to said vacuum chamber for lowering the vacuum chamber over the carrier, sealing means for effecting a seal between the vacuum chamber and the support floor to close the bottom of the vacuum chamber, a conduit interconnecting the vacuum and condensing chambers, a valve controlling the conduit, means for operating the valve to expose the mold flask in the vacuum chamber to the reduced pressure in the condensing chamber to cause the moisture in the sand to evaporate into vapor and be drawn through the conduit into the condensing chamber, condensing means in the condensing chamber to condense said vapor, means for sequentially operating said valve to isolate the vacuum chamber from the condensing chamber and for restoring the vacuum chamber to atmospheric pressure, and means for raising the vacuum chamber away from the carrier.

2. Apparatus for reclaiming moist foundry sand in a mold flask after molten metal has been poured at a pouring station into a cavity in the sand comprising means forming a condensing chamber, vacuum generating means operatively associated with said chamber for maintaining the condensing chamber at a pressure of about 1 psi absolute, means providing a vacuum station having a support floor for supporting the mold flask, an open bottom vacuum chamber at said station, means adjacent said vacuum station and connected to said vacuum chamber for lowering the vacuum chamber toward a mold flask supported on said floor, sealing means for effecting a seal between the lower edges of the vacuum chamber and the upper edges of the mold flask, said vacuum chamber having a volume less than the volume of the condensing chamber, a conduit interconnecting the vacuum and condensing chambers, a valve controlling the conduit, means for operating the valve to expose the mold flask in the vacuum chamber to the reduced pressure in the condensing chamber to cause the moisture in the sand to evaporate into vapor and be drawn through the conduit into the condensing chamber, condensing means in the condensing chamber to condense said vapor, means for sequentially operating said valve to isolate the vacuum chamber from the condensing chamber and for restoring the vacuum chamber to atmospheric pressure, and means for raising the vacuum chamber away from the mold flask.

3. Apparatus for reclaiming moist foundry sand in a mold after molten metal has been poured at a pouring station into a cavity in the sand comprising means forming a condensing chamber, vacuum generating means operatively associated with said chamber for maintaining the condensing chamber at a pressure of about 1 psi absolute, means providing a vacuum station having a support for supporting the mold means, a vacuum chamber at said station, means adjacent said vacuum station and connected to said vacuum chamber for moving the vacuum chamber toward the mold means supported on said support, sealing means for effecting a seal between the edges of the vacuum chamber and the edges of the mold means, said vacuum chamber having a volume less than the volume of the condensing chamber, a conduit interconnecting the vacuum and condensing chambers, a valve controlling the conduit, means for operating the valve to expose the sand in the mold means in the vacuum chamber to the reduced pressure in the condensing chamber to cause the moisture in the sand to evaporate into vapor and be drawn through the conduit into the condensing chamber, condensing means in the condensing chamber to condense said vapor, means for sequentially operating said valve to isolate the vacuum chamber from the condensing chamber and for restoring the vacuum chamber to atmospheric pressure, and means for moving the vacuum chamber away from the mold means.

4. Apparatus for reclaiming moist foundry sand from a mold after molten metal has been poured at a pouring station into a cavity in the sand comprising means forming a condensing chamber, vacuum generating means operatively associated with said chamber for maintaining the condensing chamber at a pressure of about 1 psi absolute, means providing a vacuum station having a support for supporting the mold, a vacuum chamber at said station, means for moving the vacuum chamber into sealing relationship with the edges of the mold, a conduit interconnecting the vacuum chamber and the condensing chamber, a valve controlling the conduit, means for operating the valve to expose the moist sand in the vacuum chamber to the reduced pressure in the condensing chamber to cause the moisture in the sand to evaporate into vapor and be drawn through the conduit into the condensing chamber, condensing means in the condensing chamber to condense said vapor, means for sequentially operating said valve to isolate the vacuum chamber from the condensing chamber and for restoring the vacuum chamber to atmospheric pressure, and means for moving the vacuum chamber away from the mold.

5. Apparatus for reclaiming moist foundry sand from a mold means after molten metal has been poured at a pouring station into a cavity in the sand comprising means forming a condensing chamber, vacuum generating means operatively associated with said chamber for maintaining the condensing chamber at a pressure of about 1 psi absolute, a carrier for supporting the mold means, a vacuum chamber, means for moving the vacuum chamber over the carrier, sealing means for effecting a seal between the vacuum chamber and the carrier to close the vacuum chamber, a conduit interconnecting the vacuum chamber and the condensing chamber, a valve controlling the conduit, means for operating the valve to expose the sand in the vacuum chamber to the reduced pressure in the condensing chamber to cause the moisture in the sand to evaporate into vapor and be drawn through the conduit into the condensing chamber, condensing means in the condensing chamber to condense said vapor, means for sequentially operating said valve to isolate the vacuum chamber from the condensing chamber and for restoring the vacuum chamber to atmospheric pressure, and means for moving the vacuum chamber away from the carrier.

6. Apparatus for reclaiming moist foundry sand in a mold after molten metal has been poured at a pouring station into a cavity in the sand comprising means forming a condensing chamber, vacuum generating means operatively associated with said chamber for maintaining the condensing chamber at a pressure of about 1 psi absolute, a carrier for supporting the mold, a vacuum chamber, means for moving the vacuum chamber into sealing relationship with the carrier to close the vacuum chamber, a conduit interconnecting the vacuum chamber and the condensing chamber, a valve controlling the conduit, means for operating the valve to expose the sand and the mold in the vacuum chamber to the reduced pressure in the condensing chamber to cause the moisture in the sand to evaporate into vapor and be drawn through the conduit into the condensing chamber, condensing means in the condensing chamber to condense said vapor, means for sequentially operating said valve to isolate the vacuum chamber from the condensing chamber and for restoring the vacuum chamber to atmospheric pressure, and means for moving the vacuum chamber away from the carrier.

* * * * *